United States Patent [19]

Rosin et al.

[11] 4,155,400

[45] May 22, 1979

[54] LADLE FOR AND METHOD OF TILTING ABOUT TWO AXES FOR POURING

[75] Inventors: George C. Rosin, South Euclid; Robert E. Kulon, Willowick, both of Ohio

[73] Assignee: McNeil Corporation, Akron, Ohio

[21] Appl. No.: 846,639

[22] Filed: Oct. 31, 1977

[51] Int. Cl.[2] ..... B22D 41/04

[52] U.S. Cl. ..... 164/136; 164/335; 222/590; 222/604

[58] Field of Search ..... 141/392, 284; 164/133, 164/136, 155, 335, 337, 437; 222/590, 604, 605, 607, 629, 166, 1, 64, 67, 356–358

[56] References Cited

U.S. PATENT DOCUMENTS

| | | | |
|---|---|---|---|
| 3,470,941 | 10/1969 | Thompson | 164/133 X |
| 3,856,183 | 12/1974 | Bauer | 222/604 X |
| 3,940,021 | 2/1976 | Sillen et al. | 222/604 |
| 3,977,461 | 8/1976 | Pol et al. | 164/335 X |
| 4,033,403 | 7/1977 | Seaton et al. | 164/136 X |
| 4,112,998 | 9/1978 | Sato | 222/604 X |

*Primary Examiner*—David A. Scherbel

*Attorney, Agent, or Firm*—Watts, Hoffmann, Fisher & Heinke Co.

[57] ABSTRACT

A vessel for liquid, especially a ladle for molten metal, is constructed and arranged to facilitate pouring of the contents in a uniform stream along a predetermined path under a uniform pressure head, while facilitating starting and stopping of the stream. To this end, the vessel is supported for rotation about first and second generally horizontal, transverse, axes. The liquid is discharged from an outlet in the vessel located on the first axis when the vessel is rotated about the first axis. By controlling rotation, a constant head of liquid and uniform discharge trajectory is established. Flow is conveniently interrupted by rotation of the vessel about the second axis to tilt the first axis and raise the discharge outlet by an amount equal to the liquid head. Flow is restarted by lowering the discharge outlet to its original position. Preferably, the first axis is horizontal during discharge. In a preferred use of the vessel, the vessel and a receptacle, such as a mold, are moved by independent drives along adjacent paths as liquid is poured into the receptacle. A movable abutment carried with the vessel engages structure associated with the receptacle to keep the vessel and receptacle aligned during pouring.

10 Claims, 7 Drawing Figures

LADLE FOR AND METHOD OF TILTING ABOUT TWO AXES FOR POURING

BACKGROUND

1. Field of the Invention

This invention relates to an improved method and apparatus for pouring liquid, such as molten metal, along a uniform discharge path or trajectory, especially into a moving receptacle.

2. Prior Art

In pouring accurately from a vessel, such as a ladle, it is advantageous to maintain the position of the discharge opening or lip at a fixed position relative to the receptacle, so that a uniform or constant path of liquid flow can be maintained with a constant rate of pour. A known way to achieve this is to rotate a ladle about an axis through the discharge opening of the ladle. See, for example, U.S. Pat. Nos. 3,977,461 and 3,556,354. In both cases, the full contents of the ladle is continuously poured into a single receptacle, and in the arrangement shown in latter patent, the liquid does not travel through a free trajectory to a receptacle, but is guided through a conduit. The methods and apparatus disclosed therein are not completely satisfactory where it is desired to pour into several receptacles without a guiding conduit and with as little change in trajectory and pour rate as possible.

SUMMARY OF THE INVENTION

The present invention provides a method of pouring by which a vessel, such as a ladle, can be rotated about an axis through the discharge opening of the ladle to establish and maintain a uniform liquid head and, hence, a uniform flow rate and trajectory, and by which the pouring can be started and stopped by a separate independent motion of the vessel about a second axis transverse to that through the discharge opening. Through a slight rotation of the vessel about the second axis, the outlet of the vessel is quickly raised to a level above the liquid head established for pouring, without changing the rotational position of the vessel about the first axis. This raising of the outlet about the second axis quickly and conveniently stops the flow of fluid. Subsequent lowering of the discharge outlet then reestablishes flow, with the liquid head or level still established at its desired height for the predetermined trajectory or path of discharge flow.

In a preferred embodiment, the ladle structure is incorporated into a moving carrier that is suspended from a monorail and driven along a path adjacent a path of moving molds. The ladle carrier is driven independently of the molds. As extensible arm associated with the ladle carrier is engageable with a mold carrier so the driven speed of the ladle carrier cannot exceed that of the mold. By driving the carrier through an air motor, for example, operated to establish a faster unrestrained speed than that at which the mold is moved, the carrier is maintained at the speed of the mold when the extensible arm is engaged with a mold carrier, assuring proper location of the discharge opening of the ladle relative to the mold sprue.

Thus, a basic feature of the invention is the provision of method and apparatus for intermittently pouring from a vessel and readily reestablishing a desired trajectory or path of liquid flow each time material is poured into a separate receptacle. Additional features reside in the manner in which the vessel or ladle is supported and rotated, and the manner in which the vessel travel is coordinated with a moving receptacle.

DETAILED DESCRIPTION OF A PREFERRED EMBODIMENT

Figure 1:
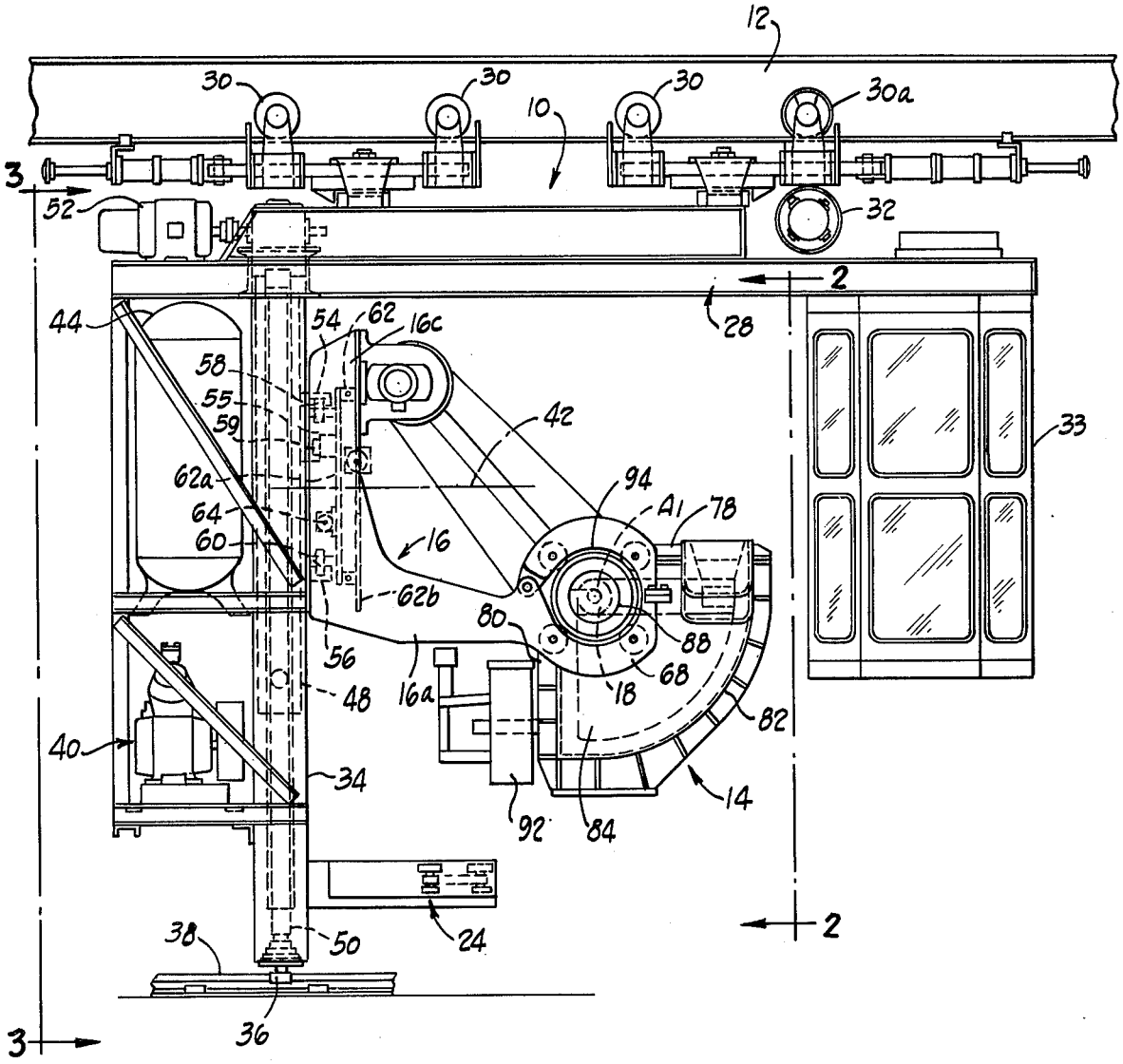
FIG. 1 is a side elevational view showing a carrier and ladle embodying the present invention.
Figure 2:
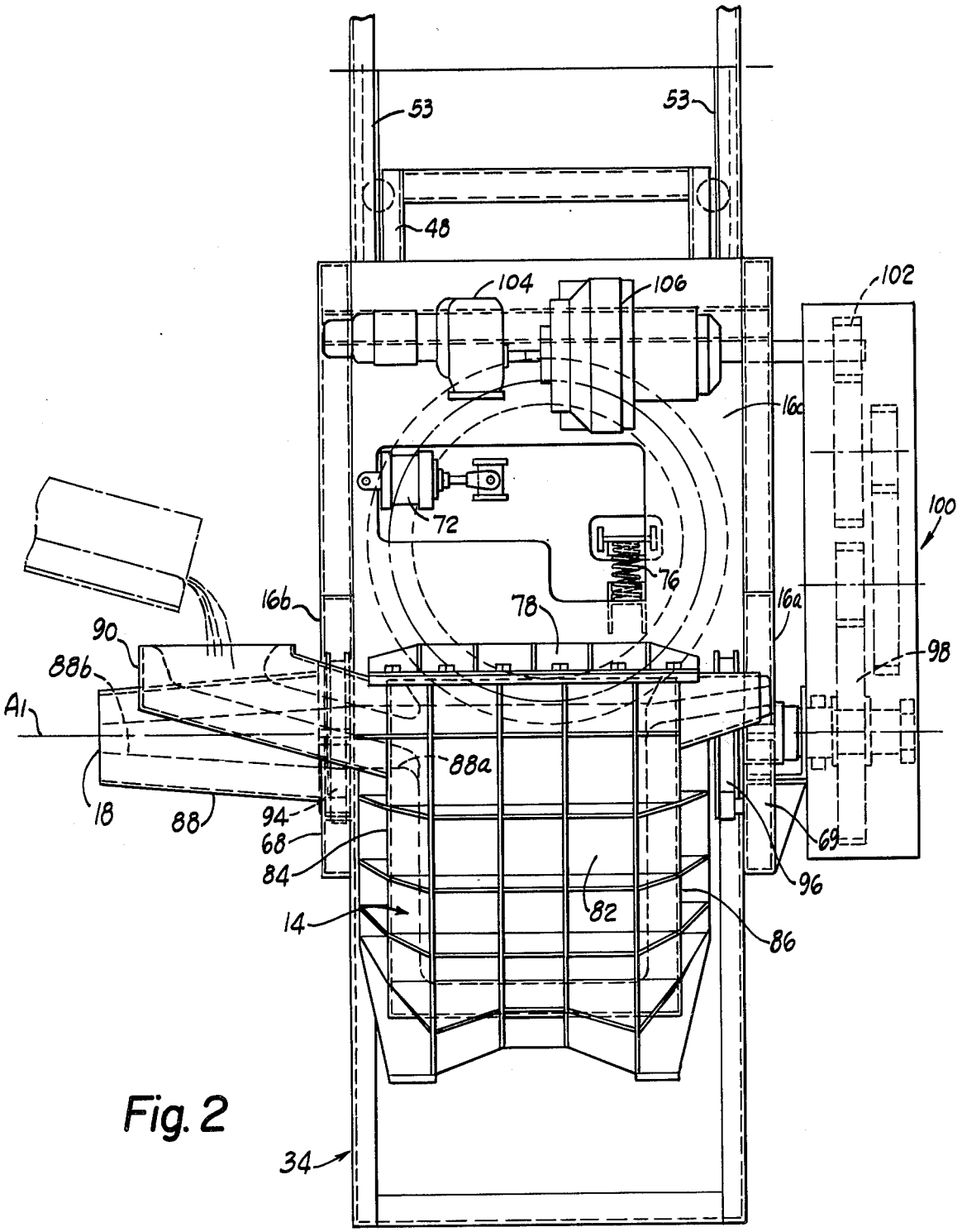
FIG. 2 is a front elevational view of the ladle and carrier taken from the plane indicated by the line 2—2 in FIG. 1.

The general Arrangement of a preferred embodiment of the invention is shown in FIGS. 1–4, where an operator-controller carrier 10 is movable along and suspended from an overhead monorail 12. A vessel, viz., a ladle 14, on the carrier is pivotally supported adjacent the top of the ladle on a yoke assembly 16. A discharge opening 18 of the ladle is located along a pivot axis A1 established by the yoke assembly support. The yoke assembly is supported for rotation about an axis A2 transverse to the axis A1, on the carrier 10, and for linear movement relative to the carrier in the direction of the axis A1. The carrier 10 is movable along the monorail 12 between a holding furnace (not shown) and a pouring zone (shown in FIG. 4). The ladle 14 is filled with molten metal at the holding furnace. At the pouring zone, the carrier 10 moves adjacent to and along a path of receptacles, viz., molds 20, movable independently of the carriers on cars 22. The ladle carrier speed is coordinated with the molds by an abutment, indicated generally at 24, associated with the carrier and riding against a mold car while the carrier drive is operated to bias the carrier abutment against the mold car. During this coordinated movement, the ladle is rotated about the first axis A1 to establish a desired liquid head and rate of discharge flow. The flow is started and subsequently stopped by rotating the ladle about the second axis A2, as the carrier movement is coordinated with successive mold cars.

The carrier 10 is comprised of a frame 28 suspended from cars 29 carried on rollers 30 that run along the monorail 12. One set of rollers 30*a* is driven by an air motor 32 in a known manner. The frame includes an operator's cab 33 at one end and a vertical column 34 at the other end for supporting the yoke assembly 16. The column 34 is guided at the bottom of the frame by rollers 36 that straddle a floor guide rail 38 that extends parallel to the monorail 12. The vertical column 34 also supports a motor and compressor unit 40, an air tank 44, and a control panel 46.

A support slide 48 is movable vertically on the column 34 by a vertical jack screw 50, and carries the yoke assembly 16. A drive motor 52 on the frame 28 rotates the jack screw 50 to drive the slide 48 vertically in guides 53 (FIG. 2) to position the ladle 14 at a desired height. Three horizontal guide channels 54, 55, 56 are on the vertical slide, opening downwardly, frontward, and upwardly, respectively. The channels receive pairs of rollers 58, 59, 60, respectively, that are secured to one element 62*a* of a vertically oriented ring bearing 62 attached to the yoke assembly 16. The horizontal guide channels and rollers together support and constrain the ring bearing 62 for horizontal movement relative to the vertical column 34. A fluid actuator 64 connected between the support slide 48 and the ring bearing element 62*a* moves the bearing and yoke assembly 16 horizontally relative to the slide 48 to transversely adjust the location of the ladle relative to the vertical column 34 and the path of carrier movement, to change the location of the discharge opening 18 of the ladle, laterally of a mold 20.

The yoke assembly 16 includes horizontal yoke arms 16*a*, 16*b* that straddle the ladle 14 and support it for rotation in spaced, horizontal aligned, bearings 68, 69. The yoke assembly also includes a vertical support portion 16*c* secured to an element 62*b* of the ring bearing 62. A fluid actuator 72 is secured between the yoke portion 16*c* and the vertical support slide 48, above the center of rotation (axis A2) of the bearing 62. Selective energization of the actuator 72 rotates the yoke assembly a short distance about the axis A2 in one direction, to a horizontal pouring position shown in FIG. 2. A compression spring 76 acts between the yoke assembly and the vertical support slide 48 to urge the yoke assembly in the opposite direction from that in which it is moved by the actuator 72, to a position where the axis A1 through the aligned bearings 68, 69 is tilted from the horizontal, with the discharge opening 18 slightly raised. In the embodiment shown, the axis A2 of the ring bearing 62 is above the axis A1 that extends through the discharge opening 18 and aligned bearings 68, 69. The plane of the ring bearing 62 is parallel to the axis A1.

The ladle 14, in its preferred configuration shown in the drawings, has a generally flat, rectangular, top wall or cover portions 78, and a generally rectangular back wall 80 vertically oriented when the ladle is in a non-rotated position prior to pouring. The top and back wall intersect along a line generally parallel to and adjacent the axis A1 that extends through the discharge opening 18. The front and bottom portion of the ladle are formed by a generally quarter-cylindrical wall 82 that adjoins the distal ends of the top and back walls. Side or end walls 84, 86 are generally flat and adjoin opposite sides of the top, back, front and bottom walls to complete the vessel. A discharge spout 88 extends from the side wall 84 along the axis A1. A filling conduit 90 also extends from the side wall 84, adjacent the top wall or cover portion 78 to one side of the discharge spout. An inductive heater 92 is attached to the wall 80 with a passage communicating to the inside of the ladle, adjacent the bottom. The inductive heater serves to maintain the temperature of the contents of the ladle at a desired level. The spout 88 of the ladle 14 is tapered from a large inlet diameter 88*a* (FIG. 2) to a smaller diameter 88*b* at the outlet 18.

Journal portions 94, 96 of the ladle are located adjacent and to the outside of the side walls 84, 86 at the axis A1, and are supported in bearings 68, 69 of the yoke arms 16*a*, 16*b*. A gear 98 is secured to the ladle on the axis A1 adjacent the journal portion 96 and is coupled through a gear train 100 to a gear 102 driven by a motor 104 and gear reduction box 106 on the yoke assembly 16, to tilt the ladle 14 about the axis A1. A brake 107 holds the ladle in a tilted position.

Figure 3:
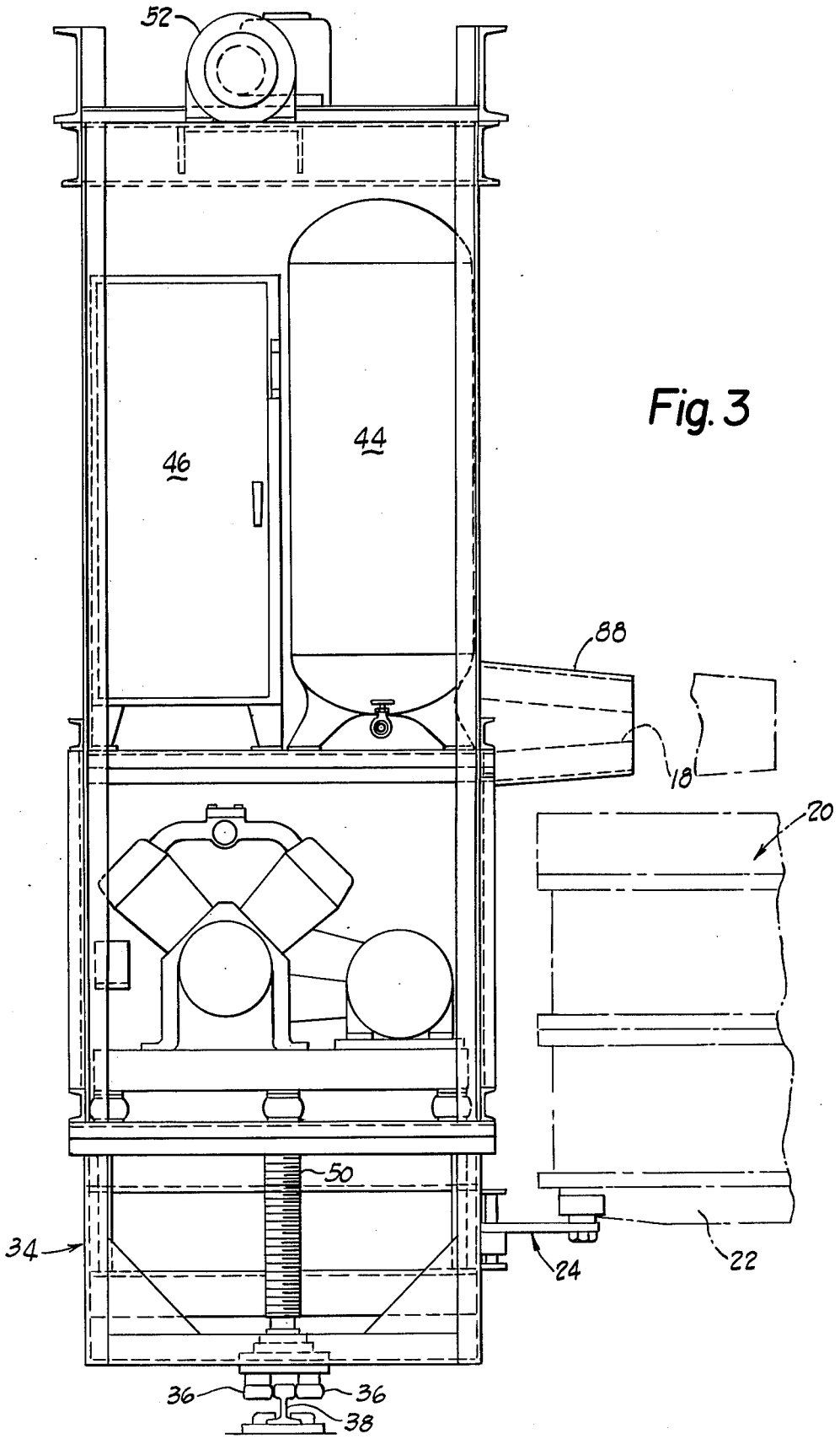
FIG. 3 is a rear elevational view of the carrier of FIG. 1, taken from the plane indicated by the line 3—3.
Figure 4:
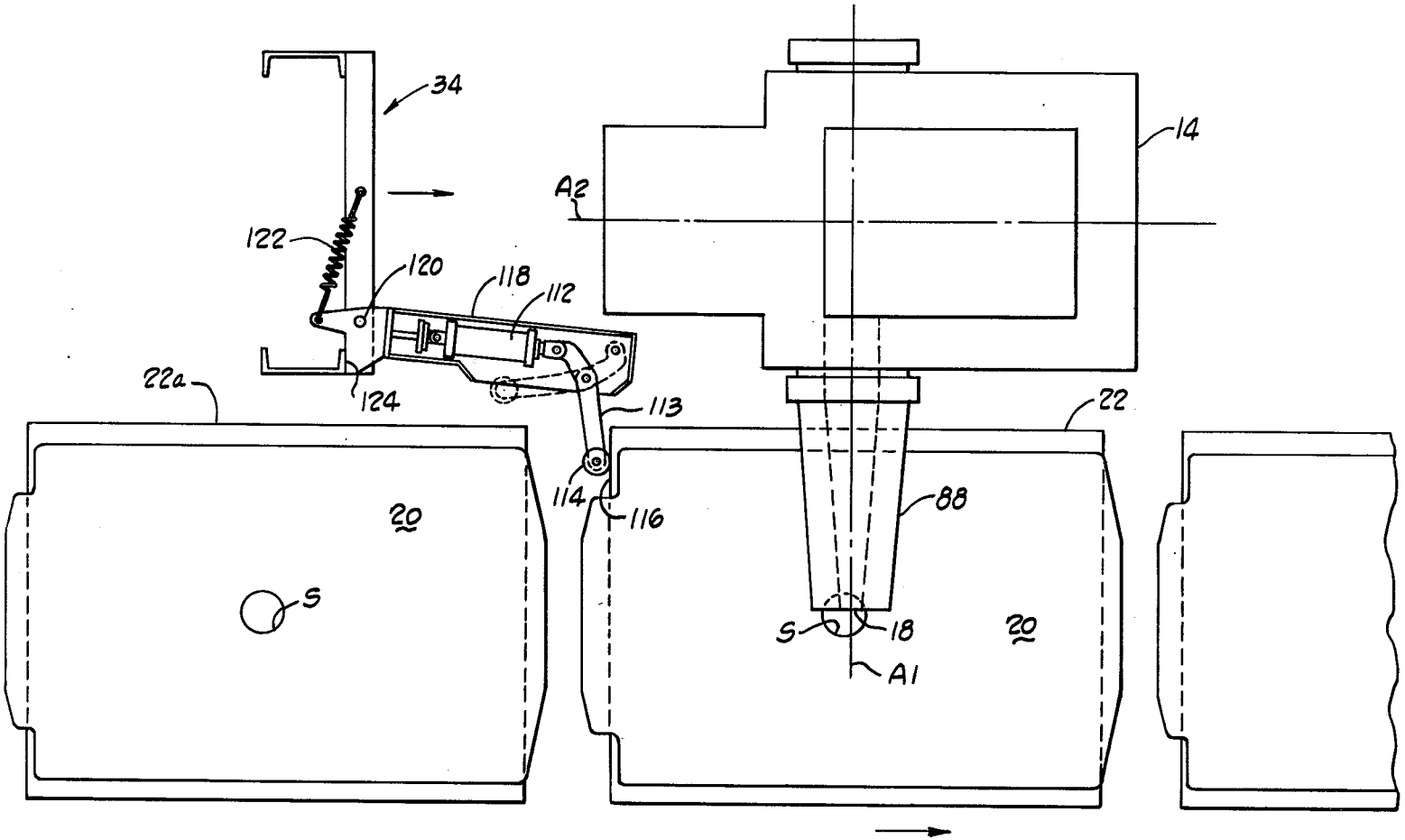
FIG. 4 is a partial diagrammatic top plan view of the carrier and mold line, illustrating the relationship of the ladle with the molds and the structure for engaging the molds to control the ladle speed.
Figure 6:
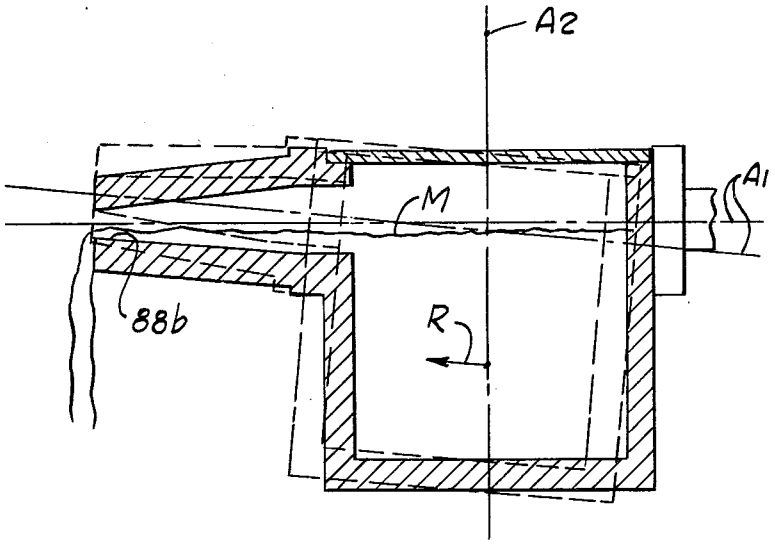
* and FIG. 6 is a partial front elevational view of the ladle of FIG. 5, diagrammatically indicating the rotational limits of the ladle about the second axis transverse to that through the ladle discharge opening.
Figure 5B:
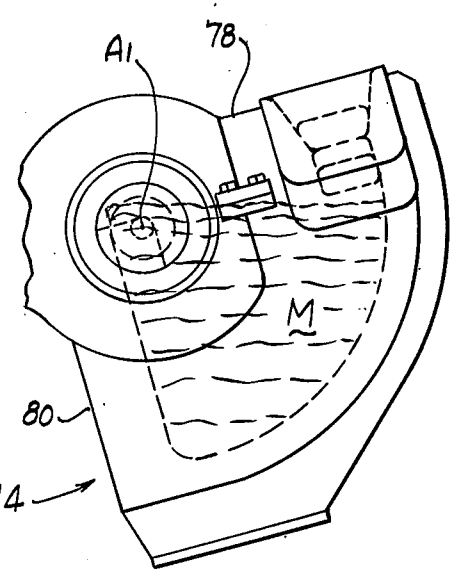
FIGS. 5A and 5B are partial side elevational views diagrammatically illustrating the ladle of FIG. 1 in a horizontal orientation in FIG. 5*a* and in a slightly rotated orientation in FIG. 5*b.
Figure 5A:
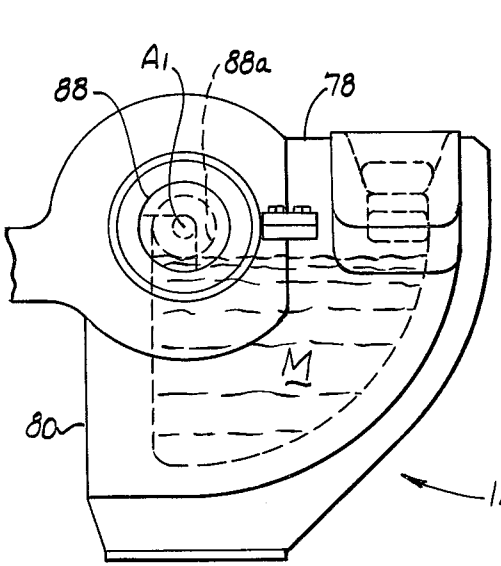

The operation of the ladle 14 is illustrated in FIGS. 5A, 5B and 6. In the position of the ladle shown in FIG. 5A, with the top wall 78 horizontal and back wall 80 vertical, the level of the contents M is no higher than the discharge opening 18, and preferably is no higher than the bottom of the inlet opening 88*a* to the spout 88. Upon rotation of the ladle about the axis A1 in a counterclockwise direction as viewed in FIGS. 1 and 5, the level of the contents M rises and enters the spout 88 and flows from the discharge opening 18. By controlling the amount of rotation of the ladle about the axis A1, the height of the liquid and hence the pressure head is controlled. When the liquid height and pressure head is maintained at a desired level by controlled ladle rotation from the motor 104, a constant flow rate is maintained through the discharge opening, producing a constant flow path or trajectory of unconfined material from the spout 88. Thus, the direction and amount of material dispensed to a receptacle located as shown in FIGS. 3 and 4, can be controlled.

While maintaining the rotated position of the ladle about the axis A1 as in FIG. 5B, the flow of material through the discharge opening can be quickly stopped by rotating the ladle about the axis A2 from the solid line position of FIG. 6 where the axis A1 is horizontal, to the phantom line position where the spout portion 88*b* is raised above the level of the contents M. This is accomplished with a small degree of rotation in the direction of the arrow R. The flow is restarted through the discharge opening 18 by rotating the ladle back to the position in which the axis A1 is horizontal. The substantial length of the spout 88 contributes to the ability to stop and start the flow from the ladle with a relatively small degree of rotation, and hence in a short time. This provides a sharp cutoff and initiation of flow, for accurate and quick flow control. Rotation about the axis A2 is controlled through the actuator 72 and spring 76.

The carrier and ladle of the preferred embodiment are constructed to pour material from the ladle into moving molds 20 carried by the mold cars 22 by driving the carrier with the air motor 32 and engaging the mold cars 22 with the abutment 24. This coordinates movement of the carrier with the mold cars in a common direction so the discharge opening 18 is properly located relative to a sprue of the mold. Proper location plus a controlled pour rate assure that the contents from the ladle is received in the mold without spillage. For purposes of coordinating the movement with successive molds, the abutment 24 is pivotally supported on the carrier 10 and can be swung into engagement with a mold when coordinated movement is desired. In the preferred embodiment shown, a pivoted arm 113 (FIG. 4) with a wheel 114 serves to engage a mold car. An actuator 112 swings the arm 113 and the wheel 114 outward so the wheel rides against the side of a car, e.g., the car 22*a*, behind the car 22 carrying the mold to be filled, while the carrier 10 moves in a path adjacent that of the mold cars and in the same direction. With the carrier moving at a greater speed than the mold cars, the wheel 114 reaches a space between the previous mold car 22*a* and the car 22 carrying the mold to be filled, and swings into the space between the cars and agasint a surface 116 at the back end of the car 22 carrying the mold to be filled. The arm 113 is urged into its extended position with sufficient force by the actuator 112 to prevent the carrier from exceeding the mold car speed.

As shown in FIG. 4, the actuator 112 and arm 113 are carried on a support 118 pivoted by a pin 120 on the vertical column 34 and biased by a spring 122 into the operative position generally parallel to the path of movement of the carrier and cars. The support 118 is located in the position shown by a stop or abutment 124 on the column 34. With the wheel 114 engaging the surface 116 of a mold car, the ladle discharge opening 18 is directly over a sprue S of the mold 20 carried by the car. Rotation of the ladle about either axis A1 or A2 does not materially affect the position of the discharge opening relative to the sprue. While the air motor 32 drives the carrier 10 in association with the mold car carrying the mold being filled, the mold car controls the speed of the carrier and ladle. When the mold is filled, the arm 113 is retracted by the actuator 112 under control of the operator and the carrier is driven to the next mold, preferably at a forward speed greater than the mold cars are moving, but alternatively in a reverse direction and then forward, to associate the ladle with a preceding or subsequent mold and mold car. The contents of the ladle 14 are sufficient to fill a plurality of molds, for the best efficiency. After a predetermined number of molds has been filled, the car 10 carries the ladle to a holding furnace, where the ladle is refilled and the car then returns the ladle to the pouring area.

While a preferred embodiment of the invention has been described in detail, various modifications or alterations may be made therein without departing from the spirit and scope of the invention set forth in the appended claims.

What is claimed is:

1. In a method of pouring a liquid from a container rotatable about a first axis that extends through a discharge opening, the steps of rotating the container about said first axis to raise the level of the liquid in the container to a predetermined height above the discharge opening to establish a desired rate of flow and an unconfined trajectory of liquid from the container when said first axis is in a first position, and thereafter rotating said container about a second axis transverse to the said first axis to tilt the container so the discharge opening is raised to a height that stops the flow of liquid from the opening.

2. In a method of pouring a liquid from a container rotatable about a first axis that extends through a discharge opening, the steps of rotating the container about said first axis to raise the level of the liquid in the container to a predetermined height above the bottom of the discharge opening to establish a desired rate of flow and an unconfined trajectory of liquid from the container when said axis is in a first position, maintaining the level substantially at said predetermined height to maintain said flow rate and trajectory for a time by continuing to rotate the container about said first axis, thereafter stopping rotation of the container about said first axis and rotating said container in a first direction about a second axis transverse to said first axis to raise the discharge opening and stop the flow from the container, and thereafter rotating the container about said second axis in a second direction opposite to the first direction and in the same amount to re-establish said flow rate and trajectory.

3. In a method of pouring a liquid into a moving receptacle, the steps of:

moving a receptacle along a first path, moving a container of liquid along a second path at least a portion of which is adjacent the first path, said container being rotatable about a first axis through a discharge opening of the container and about a second axis transverse thereto, maintaining the speed of movement of the receptacle and container essentially equal along adjacent path portions, rotating said container about said first axis to raise the liquid level to a desired height above the discharge opening to establish a desired rate of liquid flow through the opening when the first axis is in a first position, and thereafter rotating said container about said second axis to tilt said first axis in a direction that raises the discharge opening to a height that stops the flow of liquid from the opening.

4. The method of claim 3 wherein the first axis is maintained horizontal in said first position.

5. In a method of pouring a liquid into a moving receptable the steps of:

moving a receptacle along a first path, moving a container of liquid along a second path at least a portion of which is adjacent the first path, said container being rotatable about a first axis through a discharge opening and about a second axis transverse thereto, maintaining a speed of movement of the receptable and container essentially equal along adjacent path portions, rotating said container about said first axis to raise the liquid level to a desired height above the discharge opening to establish a desired rate of flow and an unconfined trajectory of liquid from the container through the opening when the first axis is in a first position, maintaining the level substantially at said predetermined height to maintain said flow rate and trajectory for a time by continuing to rotate the container about said first axis, thereafter stopping rotation of the container about said first axis and reducing the level of liquid to a height below the discharge opening by rotating said container in a first direction about said second axis, and thereafter rotating the container about said second axis in a second direction opposite to the first direction and in the same amount to re-establish said flow rate and trajectory.

6. In a method of pouring a molten metal into a moving mold, the steps of:

moving a mold along a first path, moving independently of said mold a ladle of molten metal initially at a greater speed than the mold, along a second path at least a portion of which is adjacent to the first path, said ladle being rotatable about a first axis through a discharge opening and about a second axis transverse thereto, then retarding the speed at which the ladle is moved to the speed of the mold along said adjacent portion of the second path, rotating said ladle about said first axis to raise the level of molten metal to a desired height above the discharge opening to establish a desired rate of flow and an unconfined trajectory of molten metal from the ladle when the first axis is in a first position, and thereafter rotating said ladle about said second axis to tilt said first axis in a direction that raises the discharge opening to a height that stops the flow of molten metal from the opening.

7. Apparatus for pouring molten metal from a moving ladle, comprising:

a ladle carrier movable along a predetermined path, a ladle support on the carrier and movable relative thereto in a direction transverse to said path, a ladle carried by said ladle support for rotation about a first axis through the ladle, said ladle having a discharge spout extending therefrom along said first axis, and drive means on the carrier to rotate the ladle support about a second axis transverse to the first axis.

8. The apparatus of claim 7, wherein said ladle support includes a horizontal yoke cantilevered from a vertical mounting portion of the ladle support that is movable relative to the carrier rectilinearly, said ladle support being rotatable relative to the carrier by an actuator, the axis of rotation of the ladle support on the carrier being perpendicular to and above said first axis.

9. Apparatus as set forth in claim 8 including a moving mold, means for driving said mold independently of said carrier, and means to selectively limit the speed of said carrier to that of the mold without controlling the carrier drive.

10. Apparatus for pouring molten metal from a moving ladle into a moving mold, comprising:

a ladle carrier movable along a predetermined path, a ladle support on the carrier and movable relative thereto in a direction transverse to said path, a ladle carried by said ladle support for rotation about a first axis through the ladle, said ladle having a discharge spout extending therefrom along said first axis, drive means on the carrier to rotate the ladle support about a second axis transverse to the first axis, and means carried by said carrier for coordinating a movement of the carrier along said path with the movement of a mold.

* * * * *